United States Patent [19]

Sirois

[11] Patent Number: 4,832,638

[45] Date of Patent: May 23, 1989

[54] INTEGRAL PROPULSION AND STEERING UNIT

[75] Inventor: William L. Sirois, Miami, Fla.

[73] Assignee: Copeland-Sirois Enterprises, Inc., Jefferson, La.

[21] Appl. No.: 183,236

[22] Filed: Apr. 19, 1988

[51] Int. Cl.[4] ..... B63H 25/06

[52] U.S. Cl. ..... 440/83; 440/112; 114/162

[58] Field of Search ..... 440/83, 82, 111, 112, 440/50, 52, 51, 57; 114/162, 163, 355, 356, 357, 79, 56; 29/40, 4, 527.2, 426.1

[56] References Cited

U.S. PATENT DOCUMENTS 2,521,368 9/1950 Hingerty, Jr. ..... 440/83
3,003,458 10/1961 Starns, Jr. ..... 440/112

FOREIGN PATENT DOCUMENTS 1032427 6/1966 United Kingdom ..... 440/83

*Primary Examiner*—Joseph F. Peters, Jr.
*Assistant Examiner*—Edwin L. Swinehart
*Attorney, Agent, or Firm*—Larson and Taylor

[57] ABSTRACT

A method is provided for constructing an inboard power boat. The method employs an integrated propulsion and steering unit, and involves applying an insert having an exterior shape corresponding to the exterior shape of the unit to a conventional mold for the boat hull, forming the boat hull by applying laminations to the mold so as to encapsulate the insert, removing the hull from the mold, and fitting the unit to the impression left in the hull by the insert. A universal joint is used to connect the unit to the boat engine. The integrated propulsion and steering unit includes a thrust bearing assembly disposed at the end of a shaft support barrel between the engine drive and the propeller shaft. The support barrel is formed integrally with a base plate which is secured to the boat and which also includes, a part of the integrated unit, a bore for the rudder and one or more downwardly depending propeller support struts. The bearing assembly includes a pair of oppositely active bearing units housed within a bearing housing between the propeller shaft and a flanged connector member. A unique support and sealing arrangement is provided for the bearing unit.

10 Claims, 4 Drawing Sheets

INTEGRAL PROPULSION AND STEERING UNIT

FIELD OF THE INVENTION

The invention relates to boat propulsion and steering assemblies of the type wherein the basic components of the assembly form an integral unit and, more particularly, to a method of constructing a boat using such a unit and to an improved unit having superior thrust characteristics.

BACKGROUND OF THE INVENTION

A number of different propulsion and steering assemblies have been developed wherein the basic components are formed as a one-piece or integrated unit in order to eliminate alignment problems associated with prior art assemblies arising when the different components are assembled together during manufacture or outfitting of the basic boat. Reference is made, for example, to U.S. Pat. No. 3,003,458 (Starns, Jr.) wherein an inboard boat propulsion and steering assembly is disclosed which includes a propeller shaft "log" or housing, a mounting plate, a rudder shaft "log" or housing and a downwardly depending shaft support strut carrying a propeller shaft bearing, all formed as an integral unit. It will be appreciated that this integral unit inherently provides proper alignment between the propeller shaft log and the propeller shaft bearing. The integral unit, with the propeller shaft and rudder inserted therein, can be installed as one piece, and when the unit is installed, only installation, alignment and connection of the engine and mounting of the propeller on the propeller shaft remain in order to complete the propulsion and steering assembly. Other examples of integrated units of this general type include U.S. Pat. Nos. 2,064,463 (Crosely, Jr.); 2,630,094 (Hacker); 2,895,446 (Upton); 2,934,034 (Grzesnikowski); 4,040,378 (Blanchard); 4,046,096 (Liaaen); and 4,236,478 (Mansson).

As discussed below, one aspect of the present invention concerns the provision of a unitary or integrated propulsion and steering apparatus with improved trust take-up characteristics. There are, of course, many patients generally relating to thrust bearing assemblies for boats and these include U.S. Pat. No. 2,521,368 (Hingerty, Jr.) which relates to a thrust bearing assembly adapted for use in a conventional (non-integrated) marine propeller drive assembly and including a pair of oppositely effective bearing devices.

SUMMARY OF THE INVENTION

In accordance with a first aspect of the present invention, a method is provided for constructing engine-powered, propeller-driven water craft employing an integrated propulsion and steering unit including a base member which supports the components of the unit, wherein a molding insert is added to, i.e., installed on, the base of a conventional mold for the hull of the water craft, the insert having an upper exterior shape conforming to shape of the upper exterior surface of the base member of the propulsion and steering unit. The hull of the boat is then molded by applying laminations to the hull mold with the insert installed thereon so that the laminations encapsulate the insert and so that a hull is produced having an impression of the upper exterior surface of the insert molded in the bottom thereof. The molded hull is then removed from the mold and the integral propulsion and steering unit, which has been precast and pre-machined, is fitted to said impression in said hull.

According to a further important feature of the invention, the integrated unit is connected to an engine for the water craft through a universal joint assembly to accomodate any misalignment of the engine. The propulsion and steering unit preferably includes a propeller shaft, a propeller shaft support strut connected to the base member of the unit for supporting the propeller shaft, and a thrust bearing assembly connected to the one end of the propeller shaft, and the method of the invention preferably comprises connecting an output member, connected to the thrust bearing assembly, to an engine for the craft using the universal joint assembly referred to above, so as to take up any mislignment of the engine. Advantageously, the engine is mounted on the hull of the craft under rubber mounts of relatively soft durometer rubber so as to prevent engine vibrtions from being transferred to the hull.

In a preferred embodiment of the method of the invention, the insert is positioned on the hull mold using locator pins and cooperating locator holes so as to provide predetermined positioning of the insert on the hull mold.

In accordance with a further aspect of the present invention, a unitary propulsion and steering apparatus of the general type discussed above is provided wherein the thrust take-up characteristics thereof are substantially improved relative to prior art apparatus of this type. The propulsion and steering apparatus of the invention includes a thrust bearing arrangement which is highly effective in use and which is rugged in construction in addition to possessing important advantages regarding maintenance and assembly.

More particularly, the apparatus of the present invention comprises unitary propulsion and steering apparatus, for a boat or other water craft powered by a motor, which includes: a base plate adapted to be connected to the boat, and having upper and lower surfaces; a propeller shaft support barrel joined to the base plate and extending outwardly from the upper surface of the base plate at an acute angle thereto; a rudder shaft support sleeve joined to the base plate and extending perpendicularly upwardly from the upper surface of the base plate; a propeller shaft received in the support barrel; at least one support strut connected to the base plate and depending from the lower surface thereof; a bearing carried by the support strut for supporting the propeller shaft; and a thrust bearing assembly disposed at the end of said propeller shaft support barrel between the support barrel and the propeller shaft. The bearing assembly comprises an outer bearing housing; first and second oppositely acting bearing units, each bearing unit comprising an inner race in engagement with the propeller shaft, an outer race in engagement with the bearing housing, and a plurality of roller bearings disposed between said inner and outer races; and a flanged connector member, connected to one end of the propeller shaft, for enabling connection of the propeller shaft to drive output of the boat motor. The connector member includes an abutment surface providing a lateral abutment for one of the bearing units and the propeller shaft includes a stepped portion providing a shoulder which acts as a lateral abutment surface for the other of the bearing units.

Advantageously, the flanged connector member includes a cylindrical base portion which surrounds an end portion of the propeller shaft and the bearing assembly further comprising a sealing means, disposed between the base portion and an inner surface of the bearing housing, for providing sealing between the bearing housing and the propeller shaft. The bearing apparatus housing preferably includes an annular groove therein in which the sealing means is received.

In accordance with a preferred embodiment, the propeller shaft includes a terminal portion of reduced diameter and the connector member includes a central transversely extending portion having an aperture therein through which the terminal portion of the propeller shaft extends. The apparatus also includes at least one seal disposed between the propeller shaft and the transverse portion of the connector member. This seal preferably comprises an O-ring seal and one further seal.

According to a further aspect of the apparatus of the invention, the connector member includes an internal shoulder against which the one bearing unit abuts. Further, a spacer member is located between the abutment surface of the connector member and the one bearing unit.

Advantageously, an annular thrust member is disposed around the propeller shaft in abutment with the other bearing unit and with an end portion of the support barrel, and a further sealing means is provided between (i) the support barrel and thrust member and (ii) the propeller shaft.

Preferably, the end portion of the barrel and the thrust member each include a grooved portion therein in which the further sealing means is received.

Other features and advantages of the invention will be set forth in, or apparent from, the following detailed description of preferred embodiments of the invention.

DESCRIPTION OF THE PREFERRED EMBODIMENTS

Figure 1:
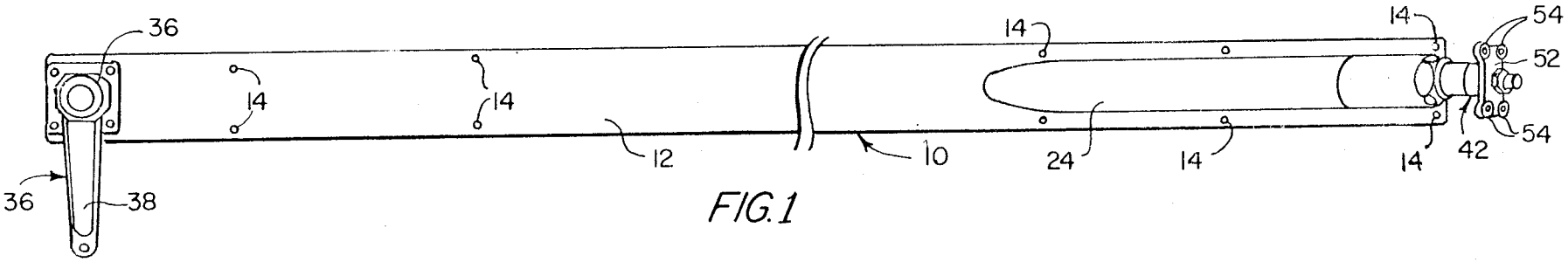
FIG. 1 is a top plan view of a unitary propeller and rudder support device or unit constructed in accordance with the present invention.
Figure 2:
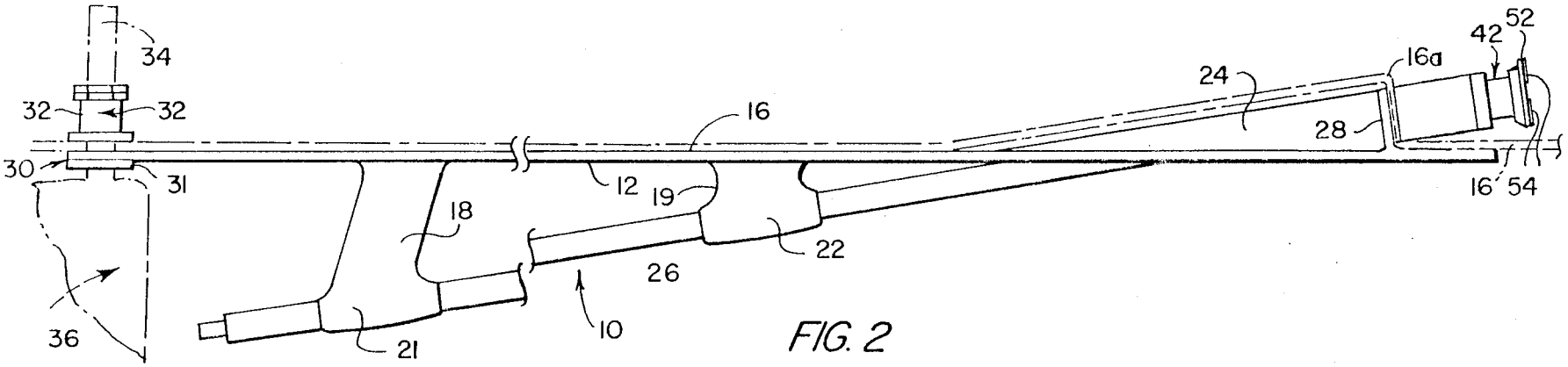
FIG. 2 is a side elevation view of the device of FIG. 1.

Referring to FIGS. 1 and 2, the support device of the invention is generally denoted 10 and includes a base plate 12 which is of elongate generally rectangular shape as indicated in FIG. 1. As is also indicated in FIG. 1, base plate 10 includes a plurality of pairs of bolt holes 14 formed therein along the length thereof which accommodate bolts (not shown) used in affixing device 10 to an inboard power boat or other craft as described below.

In this regard, and referring to FIG. 2, a portion of the bottom wall or hull of such a boat is indicated in dashed lines at 16. In the embodiment under consideration, twin propellers are used and thus two support devices corresponding to device 10 are employed but the invention is also applicable to, for example, single propeller systems as well as other hull configurations.

As shown in FIG. 2, a pair of propeller shaft support struts 18 and 19 depend from base plate 12 at spaced locations therealong. Struts 18 and 19 terminate in respective integral propeller shaft support bearings 21 and 22. Bearings 21 and 22 are preferably cutlass bearings but bearings of other types can also be employed.

Bearings 21 and 22 are mounted in alignment with an upper support barrel 24 which extends outwardly from plate 12 at a small acute angle as illustrated in FIG. 2. Bearings 21 and 22, and the bore in barrel 24 in alignment therewith, receive the propeller shaft which is denoted 26 and which extends at the aforementioned acute angle to plate 12. An integral supporting collar 28 assists in strengthening the connection between barrel 24 and base plate 12 and abuts an offset portion **16*a* of hull 16, as shown in FIG. 2**.

A rudder support section 30 comprises a reinforcement collar 31 formed integrally with base plate 12 and defining an aperture or bore (not shown) through which the rudder shaft 34 of a rudder 36 extends. A separate, conventional rudder support fitting or coupling 32 is secured to the hull 16 and serves to provide sealing and support for the rudder shaft 34 of the rudder 36. In use, the rudder shaft 34 of the rudder 36, both of which are indicated in dashed lines in FIG. 1, is inserted through the bore in base plate 12 and an aligned aperture in hull 16,and fitting 32 is used to support the rudder 36 in place and to provide the necessary sealing. The rudder shaft 34 and an associated tiller 38 are indicated to solid lines in FIGS. 2 and 3.

Figure 3:
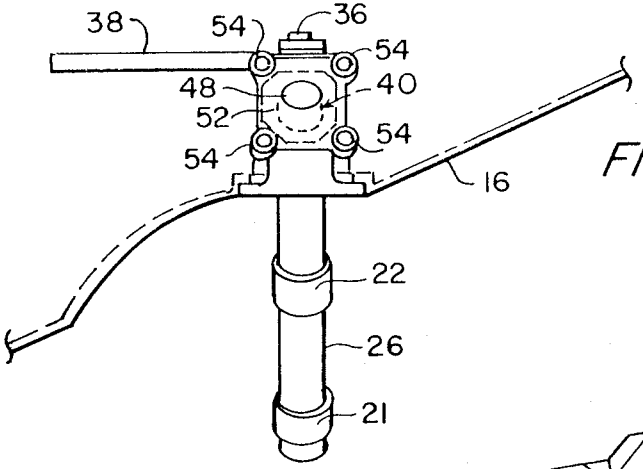
FIG. 3 is an end view of the device of FIG. 1.
Figure 4:
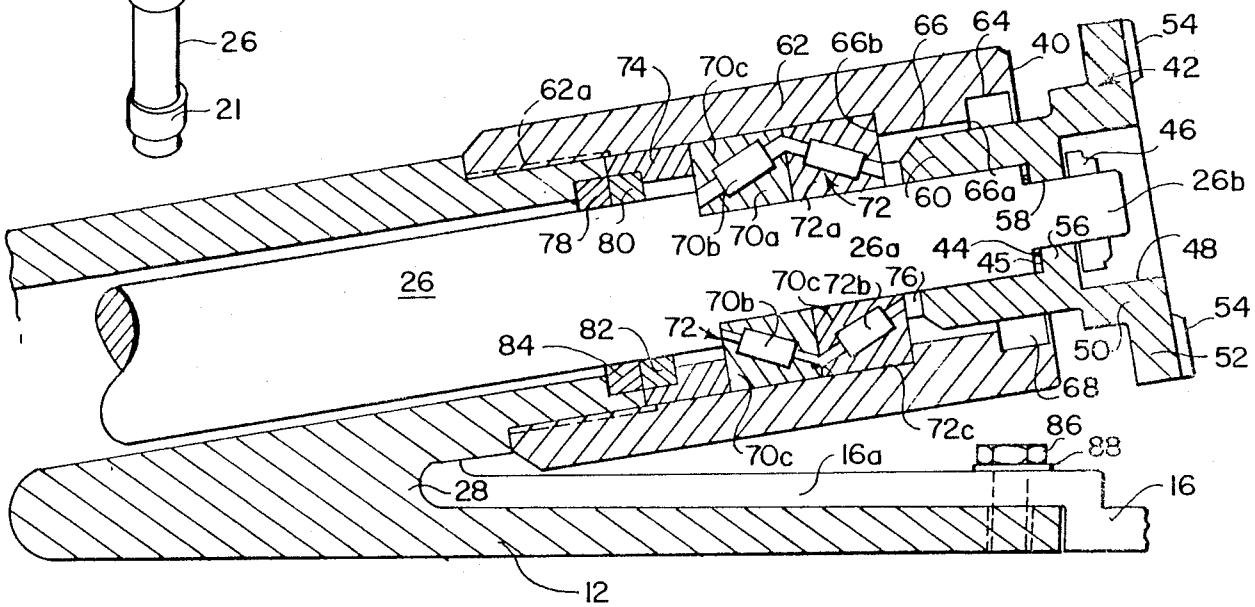
FIG. 4 is a cross sectional view, to an enlarged scale, of the thrust end of the device of FIG. 1.

As shown in FIGS. 1 to 3, but as is best seen in FIG. 4, the free end of support barrel 24 terminates in a thrust bearing assembly 40 described below.

As also illustrated in FIG. 4, propeller shaft 26 necks down at the end thereof adjacent bearing assembly 40 to a first, intermediate diameter portion or section **26*a* and terminates in a second, end portion or section 26*b*** of still small diameter.

A connecting flange member 42 is secured to end portion **26*b* by a nut 46 which is received in a central recess 48 in a head portion 50 of flange member 42. Flange member 42 further includes an integral transverse central portion 56 having an opening 58 therein through which shaft end 26*a* extends and which opens into recess 48. As shown in FIG. 4, an O-ring 44 and a special washer 45 are captured between central portion 56 of flange member 42 and the abutting face of intermediate shaft portion 26*a*. An integral cylindrical base portion 60 of flange member 42 surrounds an end portion of the intermediate section 26*a* of propeller shaft 26. As is best seen in FIGS. 1 to 3, head portion 50 includes an integral generally rectangular flange 52 having bolt holes 54 formed therein at the corners thereof by means of which the shaft 26** is connected to the drive shaft (not shown) of the motor or engine (not shown).

The thrust bearing assembly 40 includes a cylindrical housing 62 which surrounds the intermediate section **26*a* of propeller shaft 26, along with a short adjacent portion of the shaft, and which is screw threaded at 62*a* so as to be threadably received on a correspondingly threaded portion 24***a* of support barrel 24 formed of reduced diameter at the end of barrel 24. Housing 62 includes a recess 69 at the front end thereof which is partially defined by a shoulder 66*a* of an inwardly projecting annular portion 66 of bearing housing 62 and which receives an annular yoke seal 68 that provides sealing between housing 62 and the intermediate section 26*a* of propeller shaft 26.

Bearing housing 62 houses a pair of oppositely acting bearing units 70 and 72. Bearing unit 70 includes an inner race 70*a* in engagement with shaft section 26*a* and in abutment against the adjacent shoulder of shaft 26, a plurality of intermediate cylindrical roller bearings 70*b* and an outer race 70*c* in engagement with the inner wall of housing 62 and in abutment against annular thrust ring 74. Similarly, bearing unit 72 includes an inner race 72*a* in engagement with intermediate propeller shaft section 26*a* and in abutment against an annular spacer 76 disposed between bearing unit 72 and the base portion 60 of flange member 42, a plurality of intermediate roller bearings 72*b*, and an outer race in engagement with the inner wall of bearing housing 62 and in abutment with the other shoulder 66*b* of the inwardly projecting portion 66 of housing 62. A pair of annular lip seals 78 and 80 are disposed, in serial relation, between a groove 82 in thrust ring 74 and a groove 84 in the free end of barrel 24.

FIG. 4 also illustrates a bolt 86 and washer 88 used in securing base plate 12 to hull 16.

Figure 5:
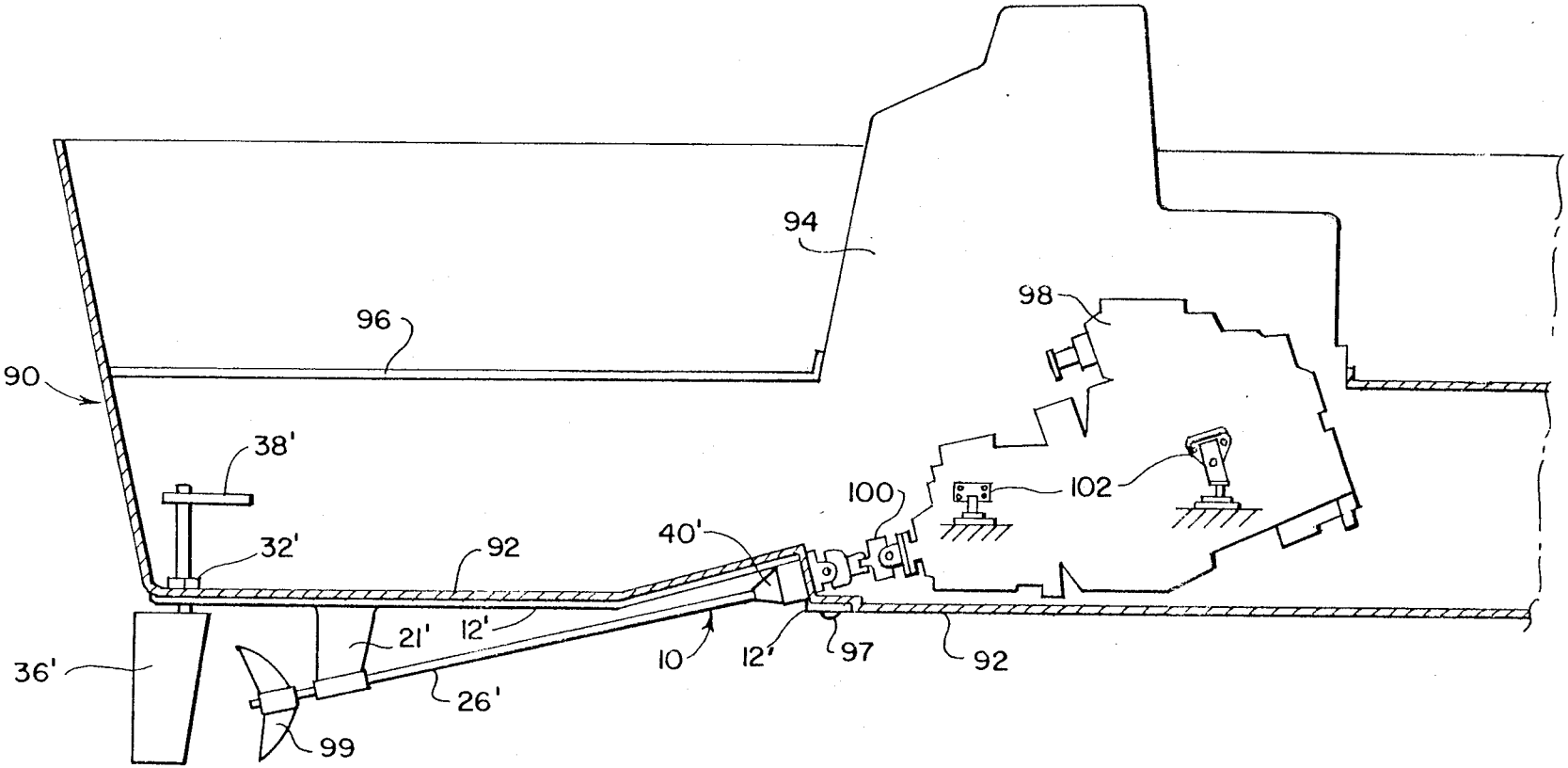
FIG. 5 is a schematic cross sectional view of an integral support unit, similar to that of FIG. 1, as incorporated in an inboard engine powered boat.

Referring to FIG. 5, an integral propulsion and steering unit or device 10' is shown mounted in place on a boat 90 including a hull 92, console 94, cockpit 96 and engine 98. The steering unit 10' basically corresponds to that of FIGS. 1 to 4 and corresponding elements have been given the same reference numerals with a prime attached. The minor differences between the two embodiments include the shape and mounting of the bearing assembly 40' of unit 10', the provision of a single shaft support strut 21', and the addition of a water pickup device 97. In addition, in the embodiment illustrated in FIG. 5, a propeller 99 is shown affixed to shaft 26'. It will, of course, be understood that the discussion which follows regarding the mounting of the unit 10' on a boat or other water craft, and regarding the method of constructing a boat using such a unit, applies equally to both embodiments.

As shown in FIG. 5, the unit 10' is connected by a conventional double universal joint assembly 100 to the engine 98 of craft 90. This is an important feature as the universal joint assembly 100 serves to take up or otherwise accommodate any misalignment between the engine 98 and the unit 10'. Engine 98 is mounted on rubber engine mounts indicated schematically at 102. As discussed above, the fact that engine misalignments are taken up as just described enables engine mounts of softer durometer rubber to be used. This feature eliminates engine vibrations from being transferred to the hull structure 92 of craft 90. With conventional prior art arrangements, harder durometer rubber mounts (corresponding to mounts 102) are necessary to maintain companion flange alignment, thereby resulting in the introduction of harmonic vibrations into the hull.

Referring to FIGS. 6 to 9, the basic steps of a method in accordance with the present invention for constructing a boat are illustrated. This method employs an integral propulsion and steering unit which is preferably of the type discussed above in connection with FIGS. 1 to 4 and FIG. 5. However, it is to be understood that the method of the invention is not limited to the particular units discussed previously.

Figure 6:
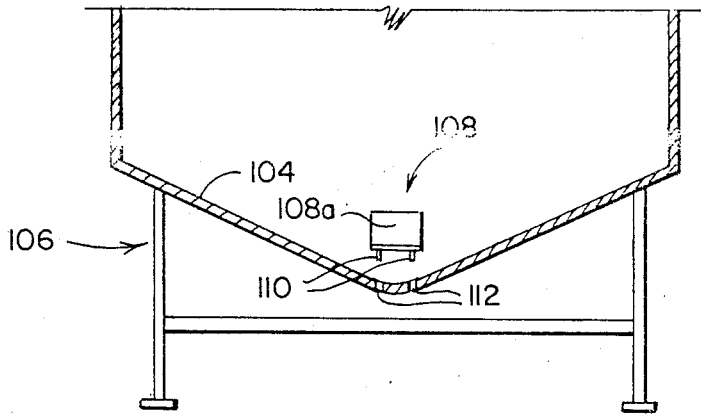
FIGS. 6 to 8 are front elevational views, partially in cross section, illustrating three steps in a method, in accordance with the invention, for constructing a boat using an integral propulsion and steering unit.

Referring to FIG. 6, a mold for the hull of a boat is indicated at 104. Mold 104 is conventional and is supported by a conventional support frame indicated at 106. In accordance with a first step of the method of the present invention, a mold insert 108 is applied to mold 104, i.e., attached as part thereof, at the base of the interior of hull mold 104 at the location corresponding to that of the integral propulsion and steering unit 10' in the finished boat. Although only the front end of insert 108 is shown in FIG. 6, the upper exterior shape thereof is such as to conform with the upper exterior shape of unit 10' including a front plate 108*a* corresponding to the front end of base 12' of unit 10' and an enlarged portion 108*b* corresponding to the "pocket" formed over thrust bearing assembly 40' of unit 10'. Locating pins 110 associated with the insert 108 are used in cooperation with holes 112 in the mold 104 to locate insert 108 in a predetermined position relative to the mold 104.

Figure 7:
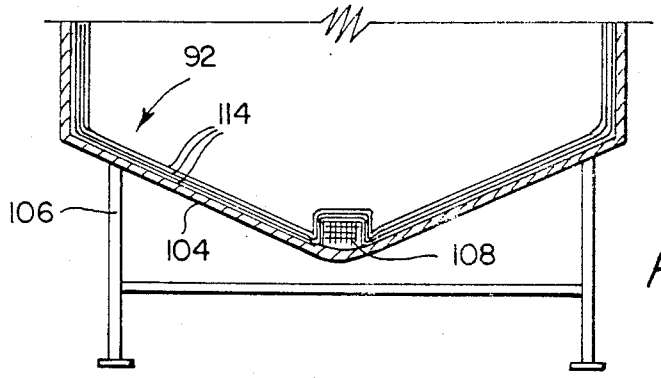

Referring to FIG. 7, with insert 108 in place, a hull 92 is formed by applying four to five layers of laminations, indicated at 114, to the hull mold 104 over the bottom and side walls thereof, and over and around mold insert 108 to provide encapsulation thereof. The lamination process is conventional apart from presence of mold insert 108 and preferably employs conventional cloth and resin laminations commonly used in forming fiberglass hulls.

Figure 8:
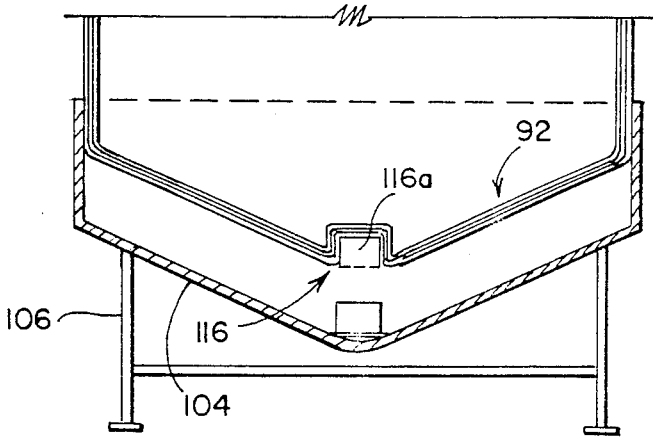
Figure 9:
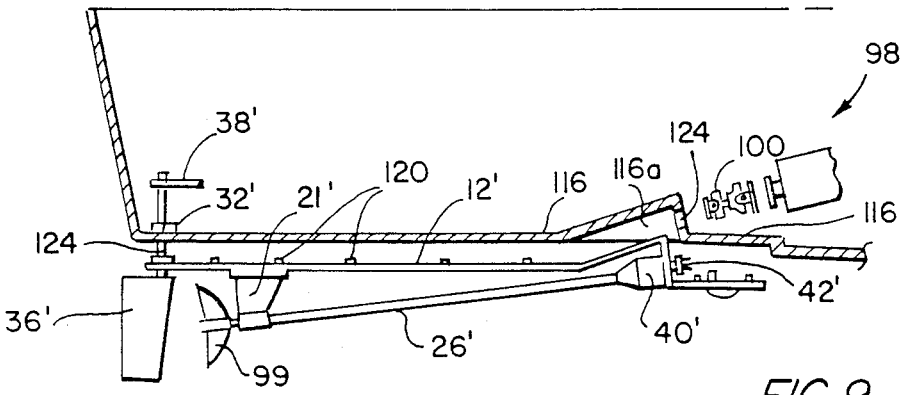
FIG. 9 is an exploded side-elevational view, partially in cross section, illustrating a further step in the method of FIGS. 6 to 8.

Referring to FIG. 8, after the laminated hull 92 has substantially cured, the hull 92 is removed from the mold 104. It will be appreciated that the hull shape provided will include an impression 116 in the bottom thereof corresponding to the shape of mold insert 108, and including, for example, a "pocket" 116*a* corresponding to the enlarged portion 108*a* of insert 108 (see also FIG. 10).

Referring to FIG. 10, a cross sectional view of the impression 116 in the bottom of hull 92 is shown, with the propulsion and steering unit 10' about to be fitted thereto. Unit 10' is bolted to hull 114 using a series of bolts, indicated at 120, as mentioned above in connection with FIG. 4. It will be understood suitable holes 122 and 124 are provided in hull 114 to accomodate connector flange 42' and rudder shaft 34', respectively, and that suitable connector fittings or couplings are provided as required to provide the necessary sealing off of the connections (e.g., a sealing fitting 32' corresponding to connector fitting 32 of FIG. 2). As described above in connection with FIG. 5, connector flange 42' is secured to engine 98 through universal joint assembly 100.

It will be appreciated from the foregoing that the method of the invention is greatly simplified as compared with conventional prior art methods used in constructing boats, thus enabling the use of relatively unskilled labor. Further, the method of the invention greatly reduces the amount of time required in actually assembling the propulsion and steering unit while ensuring at the same time that proper alignment is maintained.

Although the present invention has been described relative to exemplary embodiments thereof, it will be understood by those skilled in the art that variations and modifications can be effected in these exemplary embodiments without departing from the scope and spirit of the invention.

I claim:

1. A unitary propulsion and steering apparatus for a boat powered by a motor, said apparatus comprising: a base plate adapted to be connected to the boat and having upper and lower surfaces, a propeller shaft support barrel joined to said base plate and extending outwardly from the upper surface of the base plate at an acute angle thereto, a rudder shaft support sleeve joined to said base plate and extending perpendicularly upwardly from the upper surface of said base plate, a propeller shaft received in said barrel, at least one support strut connected to said base plate and depending from the lower surface thereof, a bearing carried by said at least one support strut for supporting the propeller shaft, and a thrust bearing assembly disposed at the end of said propeller shaft support barrel between said barrel and said propeller shaft, said bearing assembly comprising an outer bearing housing; first and second oppositely acting bearing units, each bearing unit comprising an inner race in engagement with the propeller shaft, an outer race in engagement with said bearing housing, and a plurality of roller bearings disposed between said inner and outer races; and a flanged connector member, connected to one end of the propeller shaft, for enabling connection of the propeller shaft to the drive output of the boat motor, said connector member including an abutment surface providing a lateral abutment for one of said bearing units and said propeller shaft including a stepped portion providing a shoulder which acts as a lateral abutment surface for the other of said bearing units.

2. An apparatus as claimed in claim 1 wherein said flanged connector member includes a cylindrical base portion which surrounds an end portion of the propeller shaft and said bearing assembly further comprising sealing means, disposed between said base portion and an inner surface of said bearing housing, for providing sealing between the bearing housing and the propeller shaft.

3. An apparatus as claimed in claim 2 wherein said bearing apparatus housing includes an annular groove therein in which said sealing means is received.

4. An apparatus as claimed in claim 2 wherein said propeller shaft includes a terminal portion of reduced diameter and wherein said connector member includes a central transversely extending portion having an aperture therein through which said terminal portion of said propeller shaft extends, said apparatus including at least one seal disposed between said propeller shaft and said transverse portion of said connector member.

5. An apparatus as claimed in claim 4 wherein said at least one seal comprises an O-ring seal and one further seal.

6. An apparatus as claimed in claim 1 wherein said connector member includes an internal shoulder against which said one bearing unit abuts.

7. An apparatus as claimed in claim 6 further comprising a spacer member located between said abutment surface of said connector member and said one bearing unit.

8. An apparatus as claimed in claim 1 further comprising an annular thrust member disposed around said propeller shaft in abutment with said other bearing unit and with an end portion of said support barrel, and sealing means for sealing between (i) said support barrel and thrust member and (ii) said propeller shaft.

9. An apparatus as claimed in claim 6 wherein said end portion of said barrel and said thrust member each include a grooved portion therein in which said sealing means is received.

10. An apparatus as claimed in claim 1 wherein said at least one support strut comprises a pair of support struts and said propeller shaft support bearing comprises a cutlass bearing.

* * * * *